United States Patent [19]

Evans

[11] Patent Number: 4,845,859

[45] Date of Patent: Jul. 11, 1989

[54] TOOTHBRUSH HOLDER AND DRYER SYSTEM

[76] Inventor: Norval T. Evans, 1157 NE. Stephen St., Roseburg, Oreg. 97470

[21] Appl. No.: 145,572

[22] Filed: Jan. 19, 1988

[51] Int. Cl.[4] ..... F26B 25/06

[52] U.S. Cl. ..... 34/107; 34/202; 219/374

[58] Field of Search ..... 219/366, 374; 34/202, 34/218, 104, 107

[56] References Cited

U.S. PATENT DOCUMENTS 2,184,858 12/1939 Goodman .
2,592,131 4/1949 Farrar .
3,114,038 12/1963 Meader .
3,287,824 11/1966 Selditz .
3,309,159 3/1967 Le Sueur et al. .
3,820,251 6/1974 Abernathy .

*Primary Examiner*—Henry A. Bennet
*Attorney, Agent, or Firm*—Marger & Johnson

[57] ABSTRACT

A toothbrush storage and dryer system is provided comprising an upright cylindrical housing having an open top end and closed sidewall, sized to receive at least one toothbrush inserted axially into the top end. A plate is positioned in the housing in a substantially horizontal orientation for separating the housing interior into an upper chamber for receiving the toothbrush and a lower chamber, adjacent and vertically below the upper chamber, for providing heated air to dry the toothbrush. The plate supports the toothbrush in the upper chamber while allowing air flow between the chambers. A heat source, such as a light bulb, for warming the surrounding air is disposed in the lower chamber.

19 Claims, 1 Drawing Sheet

TOOTHBRUSH HOLDER AND DRYER SYSTEM

BACKGROUND OF THE INVENTION

The present invention relates to an improved toothbrush holder and dryer system.

The conventional toothbrush and its storage between uses are well known. For instance, a toothbrush can be stored in any of various holders between uses such as a conventional toothbrush rack affixed to a bathroom wall or within a medicine cabinet. However, the toothbrush becomes wet with each use, generally several times per day. Therefore, between uses, the damp toothbrush is a fertile site for growth of bacteria, and easily becomes soiled by, for example, airborne dust and the like.

There has been widespread use of devices for sterilizing toothbrushes, bathroom cups, and even the air in the bathroom. Various such devices have been employed which include direct radiation of a toothbrush by ultraviolet light to kill bacteria (see U.S. Pat. Nos. 3,820,251; 3,114,038; 3,309,159 and 2,592,131). However, ultraviolet light bulbs significantly add to the cost of operating such devices. Furthermore, use of a direct heat source adjacent a toothbrush, without sufficient air movement, may overdry the toothbrush and damage its bristles. A direct heat source also exposes a user to the danger of burn injury if he or she touches the hot bulb when removing or replacing the toothbrush.

The overdrying problems associated with directly sterilizing a toothbrush may be somewhat ameliorated by including auxiliary mechanical devices for circulating the air within the drying chamber. This technique is shown in U.S. Pat. No. 3,820,251. However, substantial direct heating must take place in order for sterilization of the toothbrush to be effected. Moreover, the motor and fan used to move the heated air adds significant cost and complexity to that toothbrush sterilizing device.

Access for removing and replacing a toothbrush in a toothbrush holder and dryer is another important consideration. The conventional, open toothbrush rack discussed above maximizes ease of access, but leaves the toothbrush exposed to dirt, dust and airborne bacteria. U.S. Pat. No. 3,114,038 provides easy access by leaving the toothbrush generally exposed, with the toothbrush handle protruding outside the holder. That design, however, exposes the toothbrush to the pollutants noted above.

On the other hand, effective enclosure of the toothbrush can impede access during the removal and replacement operations. In U.S. Pat. No. 3,820,251, the toothbrush holder requires the user to remove the lid and reach into the container to remove or replace a toothbrush. This is difficult because the sterilization source is immediately adjacent the toothbrush racks, leaving very limited clearance for the user's fingers. It is even more difficult to replace the toothbrush because the toothbrush handle must be inserted into a small aperture sized so that the head of the toothbrush cannot fall through the rack. The same problems exist in the device shown by U.S. Pat. No. 2,592,131.

The toothbrush sanitizer of U.S. Pat. No. 3,309,159 provides a hinged access door which opens the toothbrush housing and simultaneously exposes the toothbrushes for removal. The device has numerous parts resulting in increased cost of manufacture and maintenance and is difficult to keep clean. To be cleaned effectively, a toothbrush holder must be easily accessible and/or must be easily disassembled. Complex designs, such as U.S. Pat. No. 3,309,159, are not conducive to easy and effective cleaning since interior parts are not easily accessed nor is the system easily disassembled.

Other devices, such as those directed to drying nail polish applied to the nails of a user, are shown in U.S. Pat. No. 3,287,824 to Selditz and U.S. Pat. No. 2,184,858 to Goodman.

Accordingly, a need exists for a toothbrush holder which can provide safe and effective drying of the toothbrush and easy access for removing and replacing the toothbrush, is easy to clean, and is compact, simple, inexpensive and convenient in design.

SUMMARY OF THE INVENTION

A toothbrush storage and dryer system is provided comprising an upright cylindrical housing having an open top and closed sidewall, sized to receive at least one toothbrush inserted axially into the top end. A plate is positioned in the housing in a substantially horizontal orientation for separating the housing interior into an upper chamber for receiving the toothbrush and a lower chamber, adjacent and vertically below the upper chamber, for providing heated air or dry the toothbrush. The plate supports the toothbrush in the upper chamber while allowing air flow between the chambers. A heat source, such as a light bulb, for warming the surrounding air is disposed in the lower chamber.

A retainer assembly, disposed atop the housing, includes a lid, the plate, and a rod vertically interconnecting the lid and the plate. The lid is sized to cover the top end of the housing for closing the housing, and includes a plurality of ventilation holes for allowing air to pass through it. The plate is sized to fit inside the housing for supporting the toothbrush resting on the plate with the bristle end of the toothbrush contacting the plate. It includes a plurality of holes sized for allowing the heated air to circulate upward from the lower chamber while preventing the toothbrush from falling through the plate. The rod has a length at least equal to the overall length of a toothbrush. It fixes the lid and plate in parallel relation to each other, spaced apart so that the toothbrush fits between them.

The system also includes a knob fixed to the top side of the lid for grasping and raising the retainer assembly. Raising the retainer assembly opens the top end of the housing and simultaneously lifts the plate, thereby lifting the toothbrush for removing and replacing the toothbrush. A support base can be provided for supporting the system in an upright position, including alternative structures for removably attaching the housing to the support base.

The heated air in the lower chamber flows upward without assistance from auxiliary mechanical devices. It flows through the holes in the plate to the upper chamber, past the toothbrush, and out of the housing through the ventilation holes in the lid. This gentle air flow, generally convective, warms the toothbrush without overheating it, yet drys it quickly by helping carry away water vapor.

The foregoing and additional objects, features, and advantages of the present invention will be more readily apparent from the following detailed description of a preferred embodiment which proceeds with reference to the accompanying drawings.

DESCRIPTION OF THE PREFERRED EMBODIMENT

Figure 1:
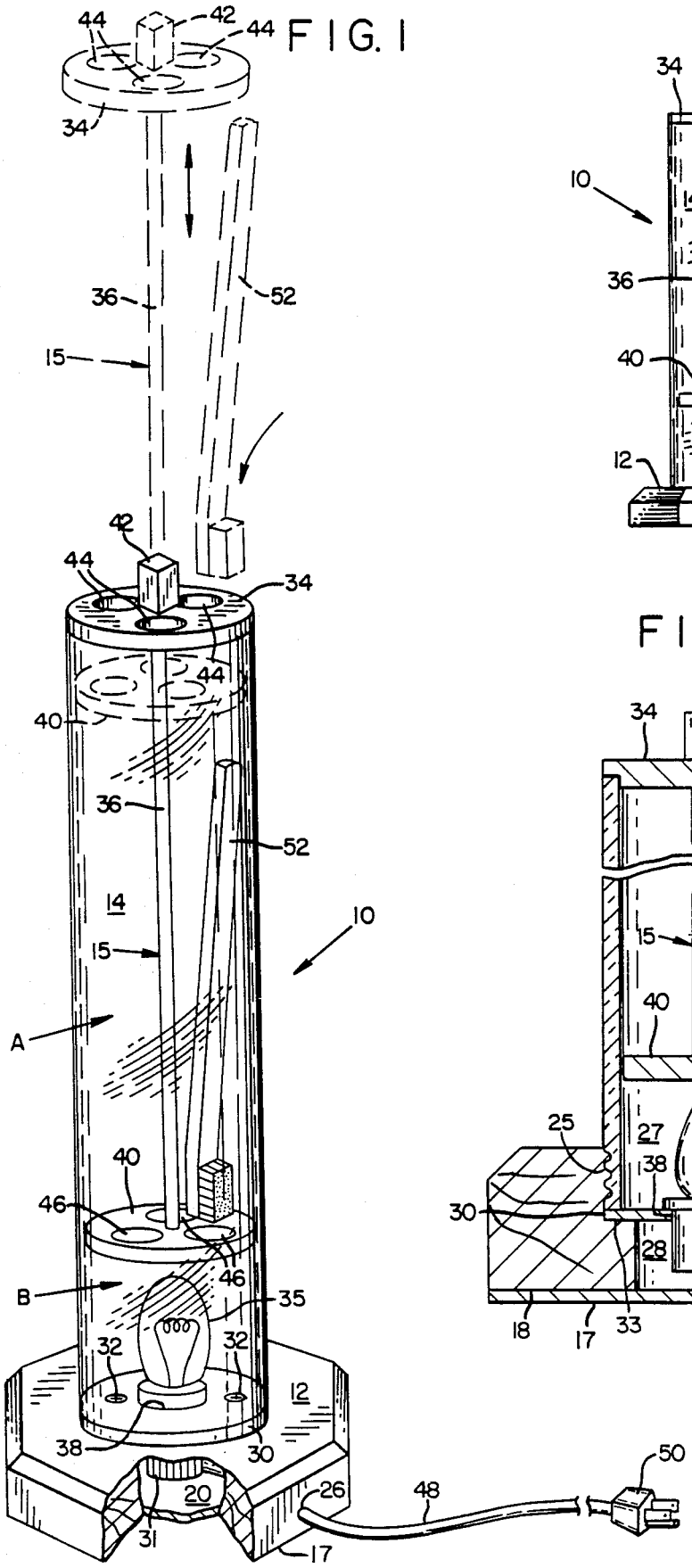
FIG. 1 is a perspective view of a toothbrush holder and dryer system according to the present invention, showing movement of the retainer assembly and a toothbrush by dashed lines.

Referring to FIG. 1, a toothbrush holder and dryer system 10 is generally depicted, comprising a cylindrical housing 14 and a retainer assembly 15.

The cylindrical housing 14 is made of any rigid material, preferably an impact-resistant polymeric material; most preferably transparent or translucent. It is open at the top end and has a diameter sized to receive at least one toothbrush 52 inserted axially into the top of the housing as shown in dashed lines in FIG. 1. The housing 14 has a length sufficient to encompass an upper chamber (A), sized to accommodate the full length of a toothbrush including the handle and a lower chamber (B), located adjacent and below the upper chamber for enclosing a heat source.

A plate 40 is movably positioned inside the housing 14. The plate is oriented in a plane normal to the axis of the housing, thereby dividing the housing into the upper chamber (A) and the lower chamber (B). The plate 40 includes a plurality, in this case three, holes 46 sized to allow communication with the lower chamber while preventing the toothbrush from falling into the lower chamber. Thus, the plate 40 supports the toothbrush 52 in the housing in a desired position, further described below. A heat source, preferably a light bulb 35, is positioned in the lower chamber. The housing 14 is transparent so that light emitted by the light bulb 35 can radiate outside the housing to serve as a night light in a home.

The system 10 includes a retainer assembly 15 for closing the top of the housing and for facilitating removing and replacing a toothbrush in and out of the system 10. The retainer assembly comprises a circular lid 34, the plate 40, and an axial rod 36 vertically interconnecting the lid and plate as described below. The retainer assembly is positioned such that the lid 34 rests on top of the housing 14, so as to cover the housing, as shown in solid lines in FIG. 1. The lid includes a plurality, in this case three, of circular holes 44 to allow air to pass out of the housing 14.

The lid 34 is joined at substantially its center to one end of the axial rod 36. The other end of the rod is joined axially to substantially the center of the plate 40, so as to fix the lid and plate in parallel relation to each other, spaced apart by the length of the rod. Thus, when the lid is atop the housing, the plate 40 is suspended into the housing 14 below the lid 34 by axial rod 36.

The rod 36 has a length, relative to the length of the housing, such that when the retainer assembly 15 is positioned in the housing, the upper chamber is long enough to accommodate the toothbrush while the plate positions the head of the toothbrush adjacent but spaced apart from the heat source in the lower chamber. Upon lifting the lid, the retainer assembly 15 rises, including the plate, thereby raising the toothbrush so that its handle extends out of the housing 14 and is easily accessible to a user. This raised position is shown in dashed lines in FIG. 1.

The light bulb 35 is activated by engaging a plug 50 into household electrical outlet. The plug provides electric current to a cord 48, connected to a light bulb socket 31, for providing current to the bulb. The light bulb 35 warms the surrounding air in the lower chamber (B). The warm air rises up through the holes 46 in plate 40, past the toothbrush 52, and out of the ventilation holes 44 in the lid 34. This convective air flow facilitates drying the toothbrush by warming it and carrying away water vapor. The system 10 thus provides for indirect heating of the toothbrush. The heat source, light bulb 35, is inaccessible by a user in normal operation thereby preventing burn injuries. A knob 42 may be fixed to the top side of the lid 34 for grasping by a user to facilitate raising and positioning the retainer assembly.

A support base 12 supports housing 14 in a substantially vertical position and is made of any suitable material such as wood or plastic. It has a flat bottom 17 so that it may rest solidly on a horizontal underlying surface. The bottom may be covered with a protective material to prevent scratching a surface on which the support base rests. The support base has an octagonal plan configuration, though its peripheral outline is not critical. The sides of the support base may be beveled as shown or otherwise decorated.

The support base 12 has a central recess 20, sized to receive the light bulb socket 31. The support base also has a bore 26, sized to accommodate the electric cord 48, providing communication between the central recess 20 and the periphery of the support base.

The housing 14 is removably mounted to the support base 12, aligned over the recess 20. To mount the housing, a flat, rigid, plastic mounting ring 30 is glued or otherwise rigidly fastened to the bottom edge of the housing 14. The mounting ring's exterior circumference is substantially equal to the outside circumference of the housing, and the mounting ring 30 is aligned with housing 14 so that it covers the bottom end of the housing. The mounting ring 30 has a central aperture 38 sized to allow the threaded base portion of the light bulb 35 to pass through it without contacting the mounting ring. The mounting ring 30 also has a pair of mounting holes 32. Screws are disposed through the mounting holes 32 and screwed into the support base, thereby fixing the housing 14 to the support base 12 over the light bulb socket 31.

Figure 2:
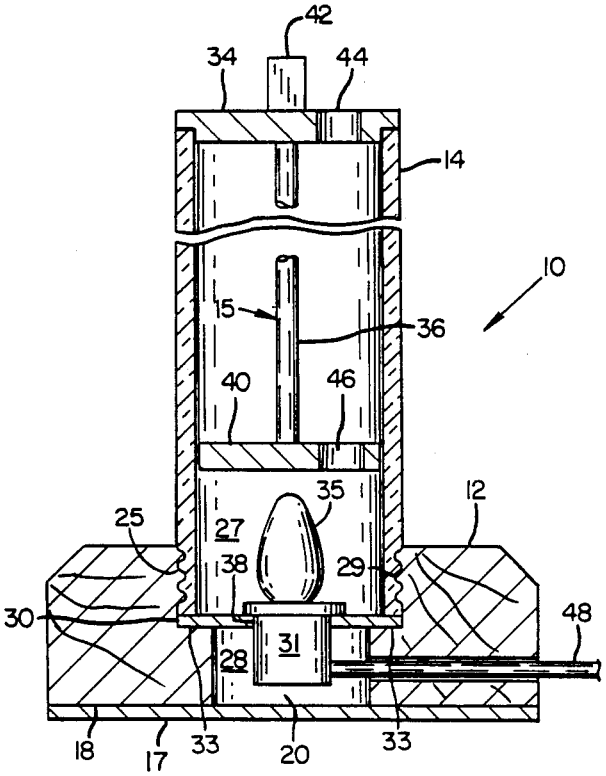
FIG. 2 is a fragmentary sectional view of the toothbrush holder and dryer system including an alternative form of housing-base connection.

Referring to FIG. 2, an alternative embodiment, the support base 12 includes a central upper recess 27 and a lower recess 28, disposed below and adjacent the upper recess. The wall defining the upper recess 27 includes a series of helical threads 29. The lower recess 28 is sized to receive a light bulb socket 31. The upper recess is larger than the lower recess such that an intermediate annular shoulder 33 is formed between the respective recesses. The socket 31 is located within the lower recess 28 so that a light bulb 35 mounted in the socket 31 extends into the upper recess 27. In this embodiment, the housing 14 has helical threads 25 on its exterior surface adjacent the bottom end. The housing 14 is attached to the base 12 by engaging threads 25 into threads 29.

Figure 3:
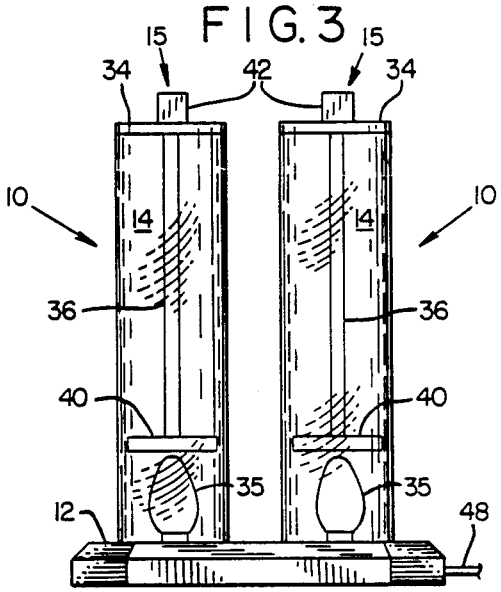
FIG. 3 is a front elevational view of an alternative embodiment including a pair of toothbrush holder and dryer systems mounted on a single support base.

In another alternative embodiment, as specifically illustrated in FIG. 3, the support base 12 supports a plurality of holder and dryer systems 10, each removably mounted to the support base in either embodiment as described above.

In operation, the user lifts the retainer assembly 15 by the knob 42. The plate 40 rises in tandem with the lid. Thus, raising the retainer assembly opens the housing 14 and brings the plate 40 near the top of, but still within the housing for convenient access. A toothbrush 52 is placed on the plate, bristle end down, and the retainer is lowered into the housing, thereby positioning the plate and simultaneously closing the housing. The bristle end of the toothbrush rests on the plate near the bulb 35, but not so near as to damage the brush.

Upon again raising the retainer assembly, the toothbrush 52 is easily removed, as it is lifted out of the housing by the plate 40. If housing 14 is constructed of transparent or translucent material, the bulb 35 also serves as a night light.

Cleaning the system 10 is easily accomplished by lifting the knob 42 until the retainer assembly 15 is completely removed from the housing 14 and washing the retainer assembly. The housing 14 may be removed from the support base 12 for cleaning, by removing the screws 32 from the mounting ring 30 or by disengaging the threaded housing in the alternative embodiment of FIG. 3. The housing is thoroughly cleaned with ease as it is open at both ends and submersible.

Having illustrated and described the principles of my invention in a preferred embodiment thereof, it should be readily apparent to those skilled in the art that the invention can be modified in arrangement and detail without departing from such principles, I claim all modifications coming within the spirit and scope of the accompanying claims.

I claim:

1. A toothbrush storage and dryer system comprising:

an elongate housing with its length oriented vertically having an open top end and closed sidewall, sized to receive at least one toothbrush inserted axially into the open top end;

means disposed inside the housing for defining an upper chamber within said housing adjacent the top end for receiving the toothbrush;

means disposed inside the housing for defining a lower chamber within said housing below the upper chamber;

means disposed within the lower chamber for heating surrounding air;

means disposed within the housing for separating the upper chamber from the lower chamber; and means within said separating means for allowing the heated air to flow upward from the lower chamber to the upper chamber.

2. The system of claim 1, wherein the separating means is arranged to support a toothbrush in the upper chamber for storing and drying the toothbrush and is vertically movable within the housing for facilitating removing and replacing the toothbrush.

3. The system of claim 2, wherein the separating means is a plate sized to fit within the housing, including a plurality of holes sized for allowing heated air to pass through the plate while preventing the head of the toothbrush from falling through the plate.

4. The system of claim 3, further comprising: closing means, positioned atop the housing, for covering the top end of the housing for keeping the toothbrush clean; and means for rigidly connecting the closing means to the plate for covering the top end of the housing and simultaneously separating the chambers.

5. The system of claim 4 wherein the closing means is a lid, sized to cover the top end of the housing, including a plurality of ventilation holes for allowing air to pass through it; and the connecting means is an axial rod, joined at one end to substantially the center of the underside of the lid and joined at the other end to substantially the center of the top side of the plate for suspending the plate at a predetermined vertical position inside the housing so that is defines the upper chamber and the lower chamber.

6. The system of claim 5, wherein the heating means is a low wattage light bulb, actuated by household electric current.

7. The system of claim 3, further comprising:

support means for supporting the system in a substantially upright position on an underlying horizontal surface; and means disposed adjacent the bottom end of the housing for removably attaching the housing to the support means.

8. The system of claim 7, wherein the housing is tubular and at least a lower portion of the housing is transparent for providing a night light.

9. A toothbrush storage and dryer system comprising:

an upright cylindrical housing having an open top end and closed sidewall, sized to receive at least one toothbrush inserted longitudinally into the top end;

heating means disposed within the housing adjacent the bottom end for heating air in the housing; and retainer means removably positioned atop the housing and depending into the housing, arranged to cover the top end of the housing and simultaneously support a toothbrush within the housing spaced above the heating means, including means for allowing the heated air to circulate upward past the toothbrush.

10. The system of claim 9 wherein the retainer means comprises:

a lid, sized to cover the top end of the housing, including a plurality of ventilation holes for allowing air to pass through it;

a plate, sized to fit inside the housing for supporting at least one toothbrush resting on the plate with the bristle end of the toothbrush contacting the plate, including a plurality of holes sized for allowing air to pass through the plate while preventing the toothbrush from falling through the plate; and a rod, having a length at least substantially equal to the length of the toothbrush, joined at one end to substantially the center of the underside of the lid and attached at the other end to substantially the center of the top side of the plate for suspending the plate at a predetermined position inside the housing, oriented parallel to the lid, when the lid is resting atop the housing.

11. The system of claim 10, further comprising a knob fixed to the top side of the lid for grasping and moving the retainer assembly to a raised position and replacing it atop the housing for removing and replacing the toothbrush.

12. The system of claim 10, further comprising:

a support base including a flat bottom for supporting the housing in an upright position on an underlying horizontal surface a and central recess for receiving a light bulb socket;

means for removably attaching the housing to the support base; and a light bulb socket disposed upright in the recess for receiving and providing power to the light bulb.

13. The system of claim 12, wherein:

the housing includes first helical threads on the exterior of a lower portion of the housing; and the support base includes an upper recess, aligned above the central recess and having a diameter greater than the diameter of the central recess, including second helical threads on the wall of the upper recess, sized to mesh with the first helical threads, for engaging the lower portion of the housing into the upper recess in the support base.

14. The system of claim 12, wherein the means for attaching the housing comprises:

a flat mounting ring having an outside diameter substantially equal to the outside diameter of the housing and having a central aperture sized so that the light bulb may pass through it without contact, rigidly fixed to the bottom end of the housing so as to cover the bottom end;

said mounting ring including a plurality of mounting holes spaced apart for attaching the mounting ring to the support base; and a number of mounting screws equal to the number of mounting holes, the threaded portion of each screw sized to pass through the mounting hole and protrude into the support base and the head of each screw sized larger than the mounting hole, the mounting screws respectively positioned in the mounting holes and screwed into the support base for maintaining the housing upright.

15. The system of claim 12 wherein the housing is made of an impact-resistant polymeric material.

16. A method of storing and drying a toothbrush comprising:

providing an upright housing having an open top end and closed sidewall, sized to receive at least one toothbrush inserted axially into the top end, including means defining an upper chamber adjacent the top end of the housing for holding a toothbrush, means defining a lower chamber located between the upper chamber and the bottom of the housing, means disposed within the housing for separating the upper chamber from the lower chamber, and means within said separating means for allowing heated air to flow between the upper and lower chambers, and further including heating means disposed in said lower chamber for providing warm air;

positioning a toothbrush in the upper chamber; and warming the air in the lower chamber so that it flow upward past the toothbrush for drying the toothbrush.

17. The method of claim 16, including:

providing a lid for closing the housing and means for supporting the toothbrush in the upper chamber while allowing air to pass through it; and wherein said positioning comprises;

raising the lid above the housing so that the support means is adjacent the top of the housing;

placing a toothbrush on the support means so that the head of the toothbrush contacts the support means and the handle of the toothbrush extends upwardly protruding out of the housing; and lowering the lid onto the housing so that it covers the top of the housing thereby lowering the toothbrush into the upper chamber.

18. The method of claim 17, further comprising providing a support base having a flat underside for supporting the housing on an underlying surface; and removably mounting the housing on the support base in a substantially upright position.

19. A method of storing and drying a toothbrush comprising:

positioning in elongate tubular housing with its length oriented vertically and having an opening at its upper end;

providing a plate sized to fit inside the housing and a lid to fit over the opening;

depending the plate into the housing from the lid atop the opening at a distance sufficient for a toothbrush to fit lengthwise between the plate and the lid;

supporting a toothbrush in the housing atop the plate; and circulating warm air upward through the housing from beneath the plate to dry the toothbrush.

* * * * *